United States Patent [19]

Yates et al.

[11] Patent Number: 4,724,557

[45] Date of Patent: Feb. 16, 1988

[54] BEDDING BOX SPRING ASSEMBLY

[75] Inventors: Chester R. Yates, Carthage; Tom L. Walkinshaw III, Joplin, both of Mo.

[73] Assignee: Leggett & Platt, Incorporated, Carthage, Mo.

[21] Appl. No.: 15,885

[22] Filed: Feb. 18, 1987

[51] Int. Cl.[4] ..... A47C 23/02

[52] U.S. Cl. ..... 5/248; 5/256; 5/261

[58] Field of Search ..... 5/246, 248, 253, 254, 5/256, 258, 261, 264 B, 268; 267/91, 100, 103, 105, 107

[56] References Cited

U.S. PATENT DOCUMENTS 683,344 9/1901 Sim ..... 5/258
3,161,408 12/1964 Molt ..... 267/91 X
4,639,957 2/1987 Wells et al. ..... 5/248

*Primary Examiner*—Alexander Grosz
*Assistant Examiner*—Michael F. Trettel
*Attorney, Agent, or Firm*—Wood, Herron & Evans

[57] ABSTRACT

A bedding foundation comprising a lower base frame, an upper wire grid and a plurality of novel spring elements interposed between the base frame and the wire grid. Each of the spring elements comprises two discrete lengths of spring wire, each of which has a center portion and two free end portions. The center portions of the discrete lengths of wire are twisted about one another to form an elongated, vertically oriented center portion of the spring element from which there extend a pair of upper spring arms and a pair of lower spring arms, the spring arms being formed by the free end portions of the two discrete lengths of spring wire.

19 Claims, 8 Drawing Figures

BEDDING BOX SPRING ASSEMBLY

This invention relates to spring assemblies and more particularly, to components of spring assemblies of the type used in bedding foundations, box springs, and other items of upholstered furniture.

In the manufacture of a box spring unit, it is generally customary to employ a matrix of coil springs or formed wire elements attached to a lower wooden base frame and an upper supporting structure. The upper supporting structure generally takes the form of a wire grid having an outer perimeter border wire and a grid of intermediate wires or bands interconnected to the border wire.

Coil springs customarily are made from a single length of wire formed into a conical or cylindrical shape. The end portion of the wire is generally formed into a circular coil or loop with the terminal end of the wire being knotted to form a circular-shaped head or end loop. This configuration of the head facilitates attachment of the head to a support structure or wire grid. The body or conical portion of the coil spring is generally formed into a helix having a plurality of spaced apart convolutions of various sizes to attain a particular desired height. The configuration of the body or conical portion of the coil allows the coil to be compressed under an applied load and then return to the original height.

Formed wire support elements represent an attempt to reduce the quantity of wire employed in a box spring. The tops of such elements are generally square or rectangular in design and are generally limited as to the means of attachment to an upper support structure. The body portions of formed wire support elements customarily extend downward in angular or fishmouth configurations to achieve minimum material content and maximum firmness while still retaining some resiliency. Such elements, though, have less resiliency than coil springs and suffer from fatigue and deformation problems. In an effort to reduce the expense of the formed wire support element, material content is reduced, but that restricts the ability of the support element to return to its original height after a load is applied. Firmness values or load-bearing characteristics of the formed wire support elements are maximized in an effort to eliminate deformation and/or wire fatigue. To compensate for the firmness of box springs containing formed wire support members, such box springs are customarily used with mattresses which provide the resiliency required for a satisfactory sleep product. The matress unit, though, then becomes the active performing member of the combination with life expectancy of the mattress greatly reduced because of the lack of resiliency of the box spring unit.

It has been an objective of this invention to provide an improved box spring assembly which has the flexibility characteristics of a round coil spring assembly, as well as many of the advantages of a formed wire support element spring assembly, but without the characteristic fatigue and deformation characteristics of a formed wire support element spring assembly.

The invention of this application comprises a box spring having novel spring elements adapted for interconnection at the bottom to a base frame and at the top to a supporting structure by means of clips, hog rings, pigtail wires, or universal snap-in formations.

In accordance with one aspect of the invention, each spring element comprises two continuous lengths of spring wire with the centermost portions of the wires twisted or wrapped one around the other to form a rigid center section. The uppermost terminations of the wires form opposed spring arms extending outwardly from opposite sides of the twisted center portion. Each upper spring arm extends outwardly in a horizontal plane from the twisted center portion and then spirals upwardly to a generally curvilinear semicircular end portion. The semicircular end portions of the upper spring arms form an unknotted, generally circular end loop located in a horizontal plane to provide a flat end loop for interconnecting the top of the spring element to the upper support structure. In one preferred embodiment of the invention, the curvilinear end portions of the upper arms terminate in an N-shaped end configuration adapted to provide a snap-in interconnection with the upper support structure.

The lowermost portions of the continuous lengths of spring wires also form a pair of spring arms of generally the same shape as the uppermost spring arms but on a smaller diameter scale. Both lower arms terminate in planar semicircular end portions which together form an end loop for interconnection to the lower wooden base frame.

The configured arrangement of each spring arm section of the support element offers resiliency while still enabling the spring element to react throughout its length to enhance resistance to the applied load. The centermost portion of the support element maximizes use of material content without restricting the spring arms and minimizes the possibility of permanent deformation and/or wire fatigue.

The present invention is described in relation to a box spring assembly, but it will be understood that the invention is not limited to a box spring and has applications to other spring unit assemblies. It will also readily become apparent that the invention incorporates a novel, but relatively inexpensive, spring which achieves efficient use of material in providing firmness and resiliency to support the top of a box spring or load-bearing spring assembly.

These and other unique and novel features and advantages of the invention will more clearly and fully appear in the following description of the drawings in which.

Figure 1:
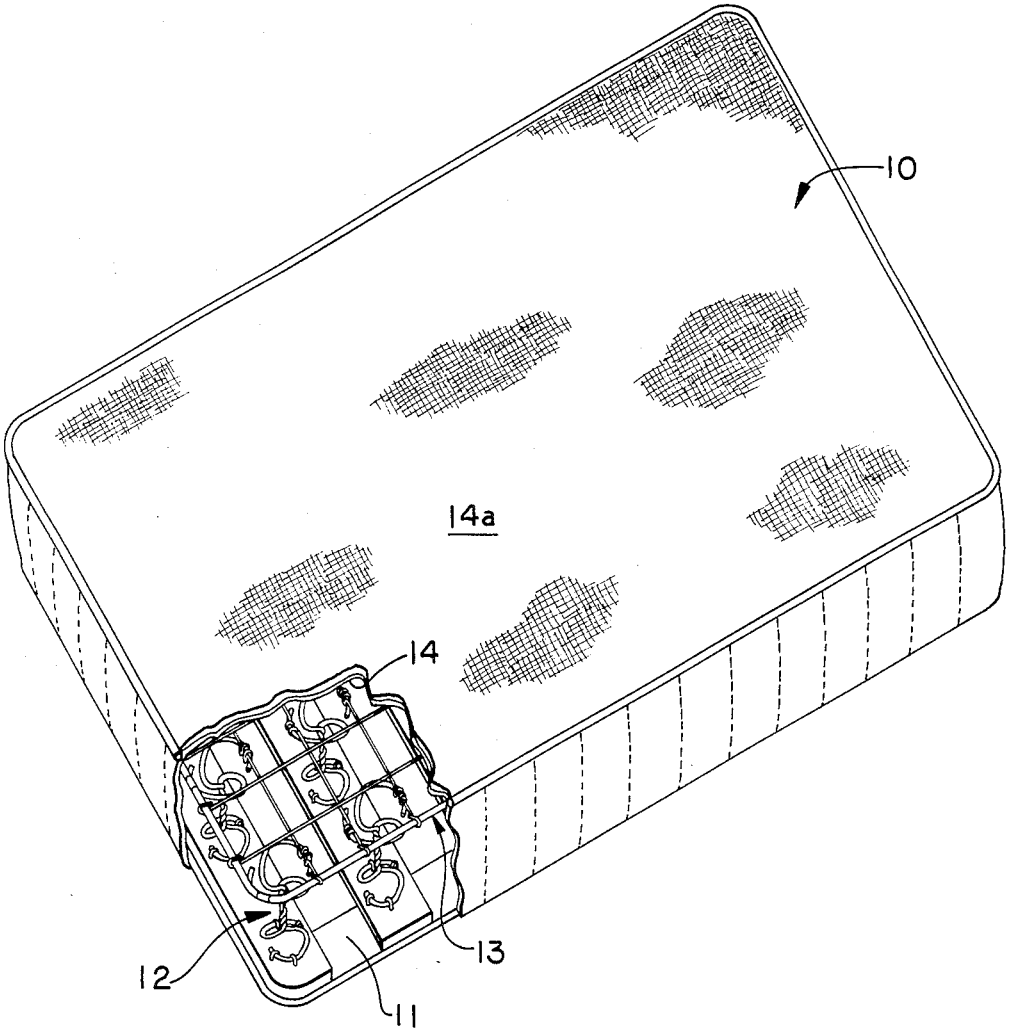
FIG. 1 is a perspective view, partially broken away, of a box spring incorporating the invention of this application.

With reference first to FIG. 1 there is illustrated a box spring 10 incorporating the invention of this application. This box spring 10 is generally rectangular in configuration and comprises a lower wooden base frame assembly 11, a plurality of spring support elements 12, and an upper spring support structure or wire grid 13. The wire grid 13 is covered by padding 14 and the complete assembly, including the base frame 11, spring elements 12, wire grid 13, and padding 14 are all enclosed or encased within a fabric covering 14*a*.

Figure 2:
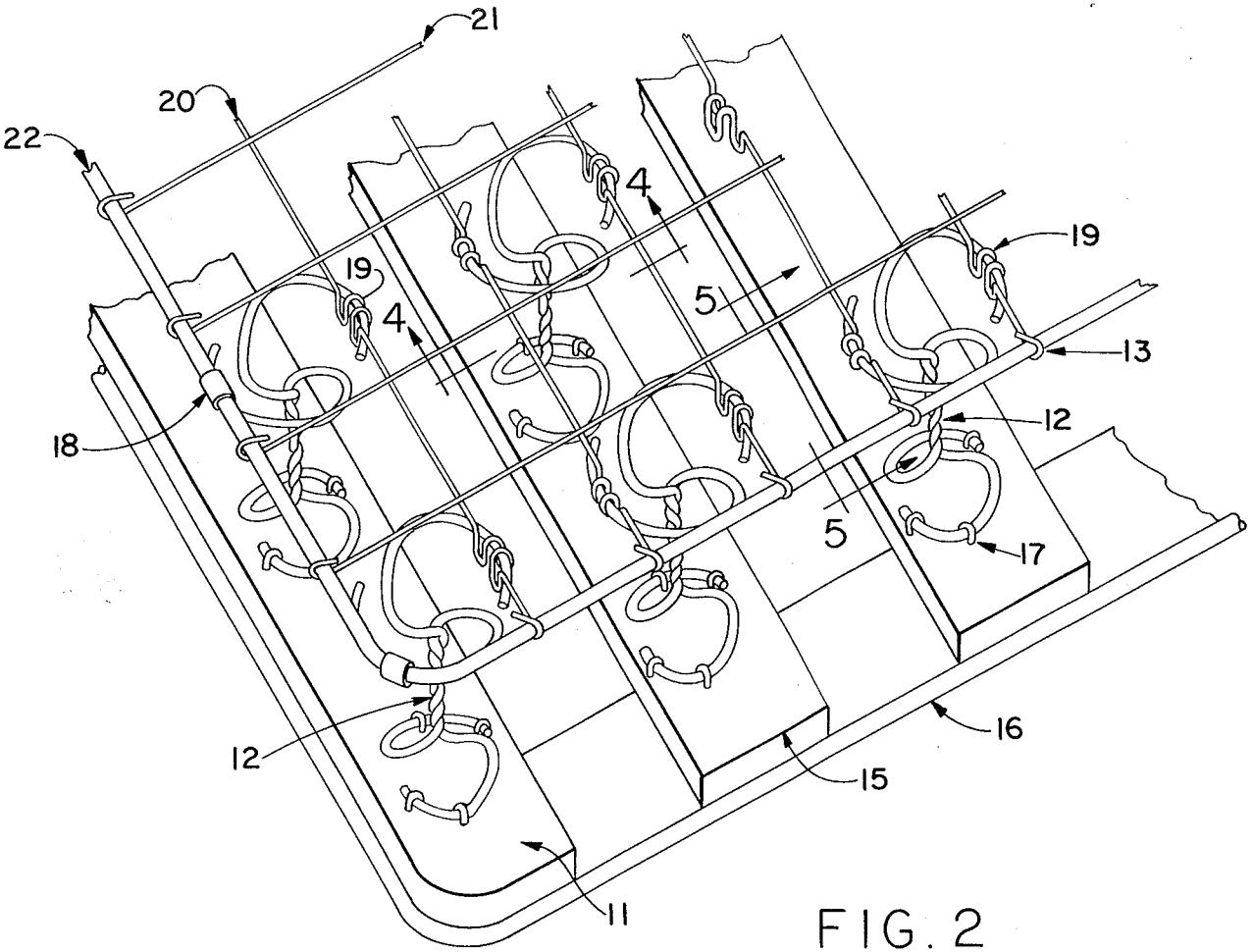
FIG. 2 is an enlarged perspective view of a corner portion of the box spring of FIG. 1, but with the upholstered covering and padding removed to better illustrate the spring assembly of the box spring.

The base frame assembly 11, as may be better seen in FIG. 2, comprises a plurality of transversely extending spring support members or wooden boards 15 which extend between and are attached to wooden longitudinal side rails 16. This wooden frame provides a rigid structure for attachment of the spring support elements 12 and the fabric covering 14*a*.

Mounted atop the wooden base frame there are a plurality of the spring support elements 12. These spring support elements are arranged in rows and columns and are attached at the bottom to the top surface of the transversely extending boards 15 of the base frame 11 by means of staples 17. At the top, each of the spring support elements 12 is attached to the wire grid 13 by means of conventional sheet metal clips 18 and hooks 19 preformed in the wires of the grid as explained more fully hereinafter.

The upper spring support structure or wire grid comprises a border wire 22, a plurality of spaced, transversely extending grid wires 20, and a plurality of spaced, longitudinally extending grid wires 21. The transversely extending grid wires extend between opposite sides of the border wire, and at the ends, are wrapped around the border wire. The ends of the transverse wires 20 are preferably welded to the border wire. Similarly, the longitudinally extending grid wires 21 extend between opposite sides of the border wire and are wrapped at the ends around the border wire. The longitudinal wires are also preferably welded to the border wire. At the crossing points or intersections of the longitudinally extending grid wires 21 and the transversely extending grid wires 20, the wires are preferably secured together by welds. Together, the grid wires form a matrix of pockets in the top wire grid for reception of the tops of the spring support elements 12.

The transverse wires 20 of the wire grid preferably have downwardly open U-shaped hooks 19 formed therein for reception of the top portion of the spring support elements 12. These U-shaped hooks formed in the transverse wires are conventional and per se form no part of the invention of this application. A more complete description of these hooks and the manner in which they are formed is to be found in Ciampa, et al. U.S. Pat. No. 3,577,574.

Figure 3:
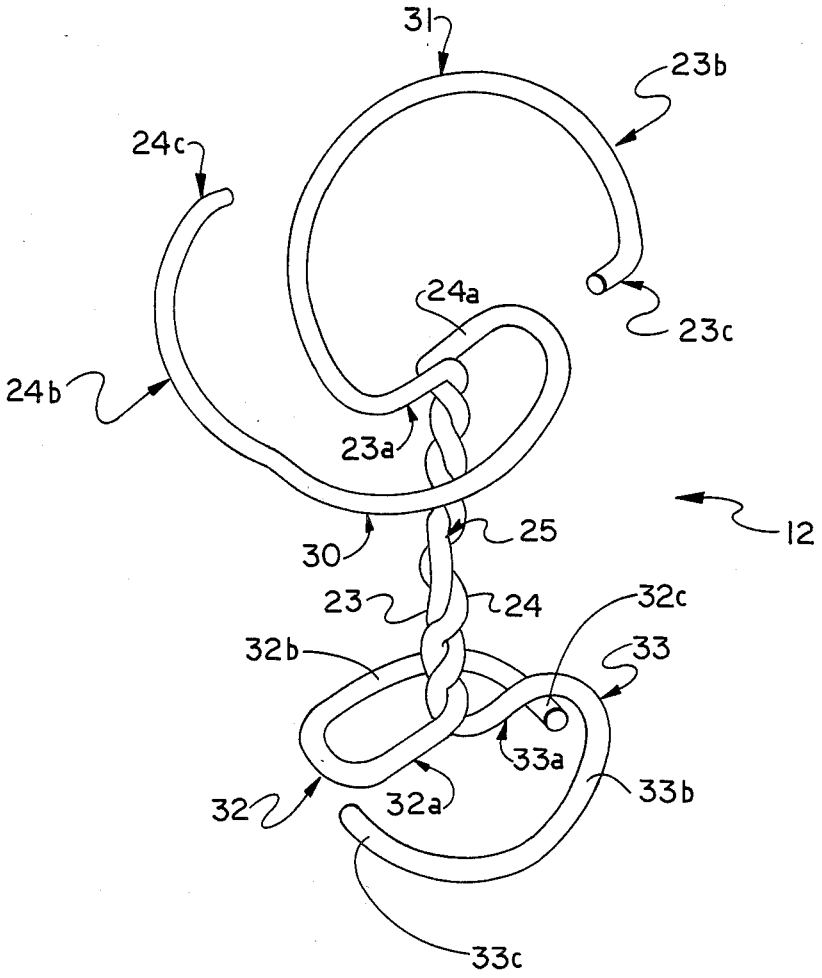
FIG. 3 is an enlarged perspective view of one spring element of the box spring of FIG. 1.
Figure 4:
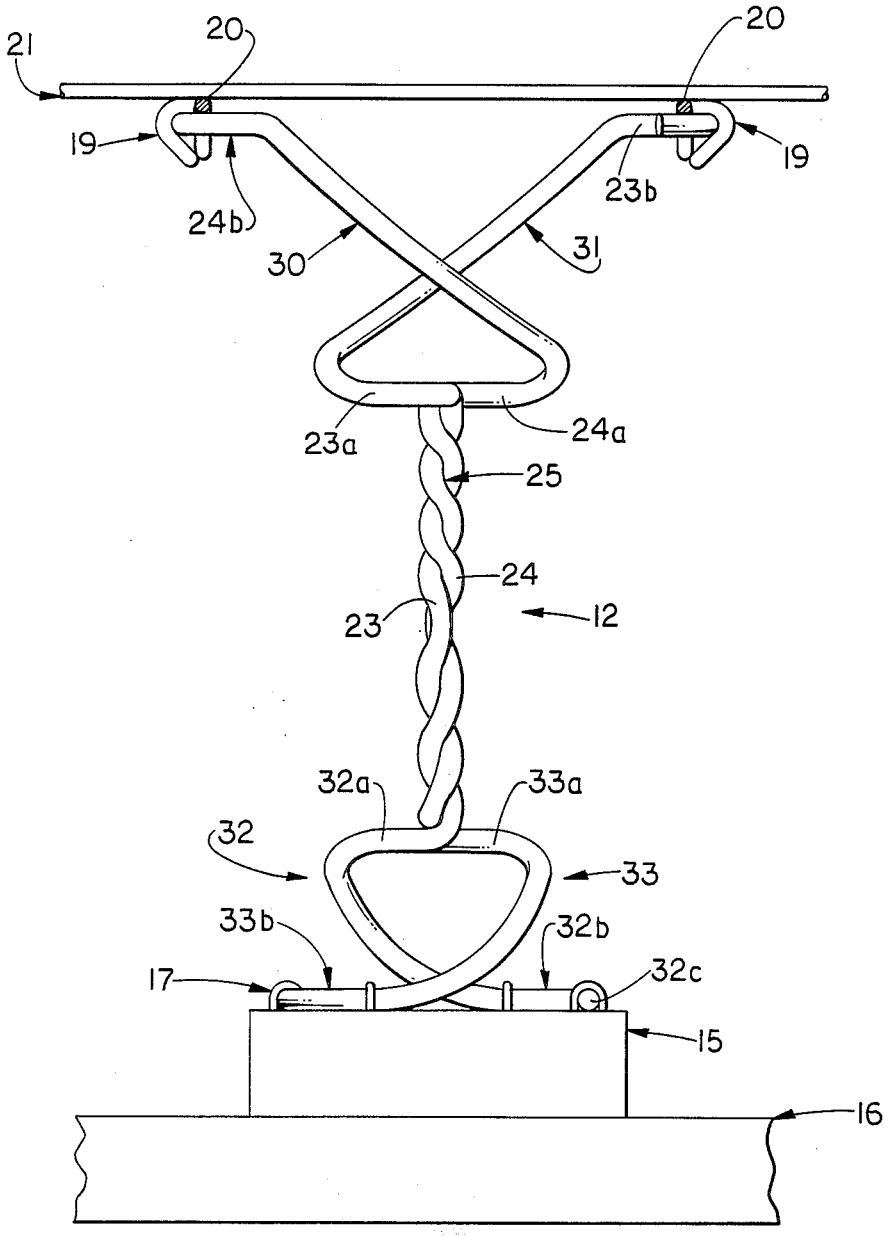
FIG. 4 is a cross-sectional view, on an enlarged scale, taken along lines 4—4 of FIG. 2, illustrating a preferred embodiment of the invention and a preferred method of attachment of the springs of the assembly to an upper welded wire grid and a lower wooden frame.
Figure 5:
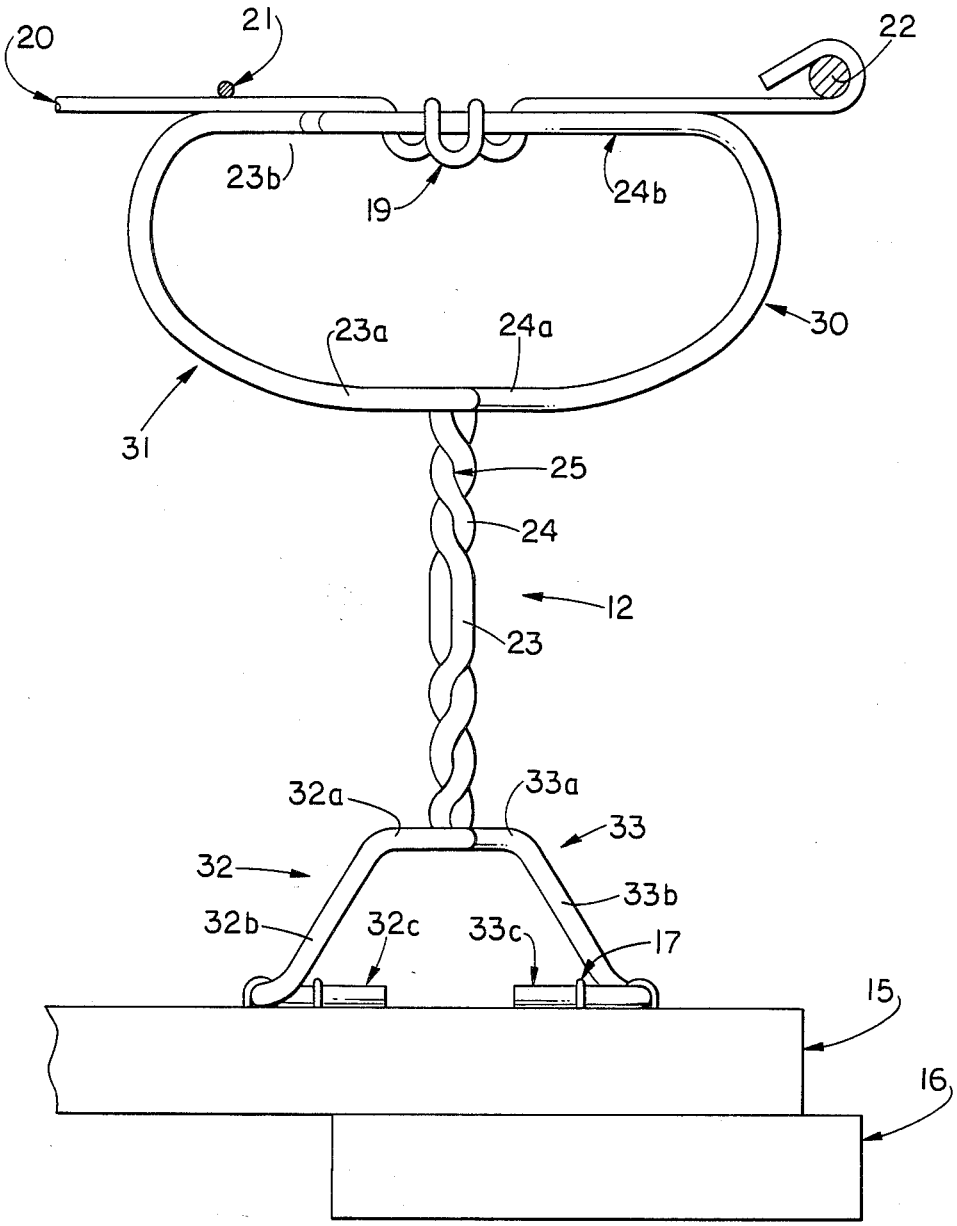
FIG. 5 is an enlarged cross-sectional view taken along lines 5—5 of FIG. 2.

With reference now to FIGS. 3, 4 and 5, it will be seen that each of the spring support elements 12 comprises two discrete sections of spring wire 23, 24 of equal length. These two discrete sections of spring wire have the center portions thereof twisted one around the other to provide a rigid, vertically extending center section 25. This center section extends for approximately one-half of the height of the support element. Extending from the top of the center section 25 there are a pair of upper spring arms 30, 31, and similarly, extending from the bottom of the rigid section 25 there are a pair of lower spring arms 32, 33. These spring arms are formed by the terminal end sections of the two discrete lengths of spring wires 23, 24.

The upper spring arms 30, 31 are formed by terminal end portions of the wires 24, 23, respectively, which extend outwardly in horizontal sections 23*a*, 24*a* from opposite sides of the center section 25 of the spring support element 12. From these horizontal sections 23*a*, 24*a*, a semicircular section 23*b*, 24*b* spirals upwardly to arcuate end sections 23*c*, 24*c*, respectively. The arcuate end sections 23*c*, 24*c* are located in a common horizontal plane spaced upwardly from the horizontal plane of the horizontal sections 23*a*, 24*a*. The arcuate end sections 23*c*, 24*c* are received within the hooks 19 of the transverse grid wires and are secured within the hooks by having the hooks crimped shut after reception of the terminal end sections 23*c*, 24*c* therein.

The lower spring arms 32, 33 of the spring support elements 12 are identical in shape to the spring arms 30, 31. They differ only in that the lower spring arms 32, 33 are smaller in diameter than the upper spring arms 30, 31.

With reference still to FIGS. 3, 4, and 5, it will be seen that the lower spring arms 32, 33 comprise a pair of horizontal sections 32*a*, 33*a* which extend outwardly in a horizontal plane from the lower ends of the twisted center section 25 of the spring support element. From these horizontal sections 32*a*, 33*a*, the arms spiral downwardly in semicircular sections 32*b*, 33*b*, respectively. Each spring arm then terminates in arcuate end sections 32*c*, 33*c*, both of which are located in a common horizontal plane spaced downwardly from the horizontal plane of the horizontal sections 32*a*, 33*a*. The end sections 32*c*, 33*c* rest atop the transverse spring supports 15 and are stapled thereto by the staples 17.

The spring support elements 12 are all identical and therefore only one spring support element has been illustrated in FIGS. 3, 4 and 5 and described in detail herein. It should be appreciated, though, that there are a plurality of such spring elements 12 in each box spring assembly 10.

In the manufacture of the box spring assembly 10, the wooden frame 11 is first preassembled. The lowermost spring arms 32, 33 of the spring support elements 12 are then attached to the top of the wooden base frame 11. The preassembled welded wire grid 13 is then placed over the top of the spring elements 12 with the terminal end portions 23*c*, 24*c* of the upper spring arms of the innermost spring arms located within the hooks 19 preformed in the transverse wires 20. The terminal end portions 23*c*, 24*c* of the outermost spring arms are attached to the border wire of the wire grid by the metal clips 18. Padding 14 is then placed over the top of the welded wire grid and the complete assembly encased within fabric covering 14*a*.

With the box spring assembly so assembled, the individual spring arms 30, 31 and 32, 33 of the spring support elements 12 act as independent springs connected to a substantially rigid post or center section 25. As a consequence of this construction, each spring arm of each spring element has substantial flexibility when a load is placed atop the box spring assembly, but the spring element still maintains rigidity to prevent complete collapse of the box spring. It also is not subject to overstressing and becoming permanently deformed, as in the case of many prior art formed wire spring bedding foundations.

Figure 6:
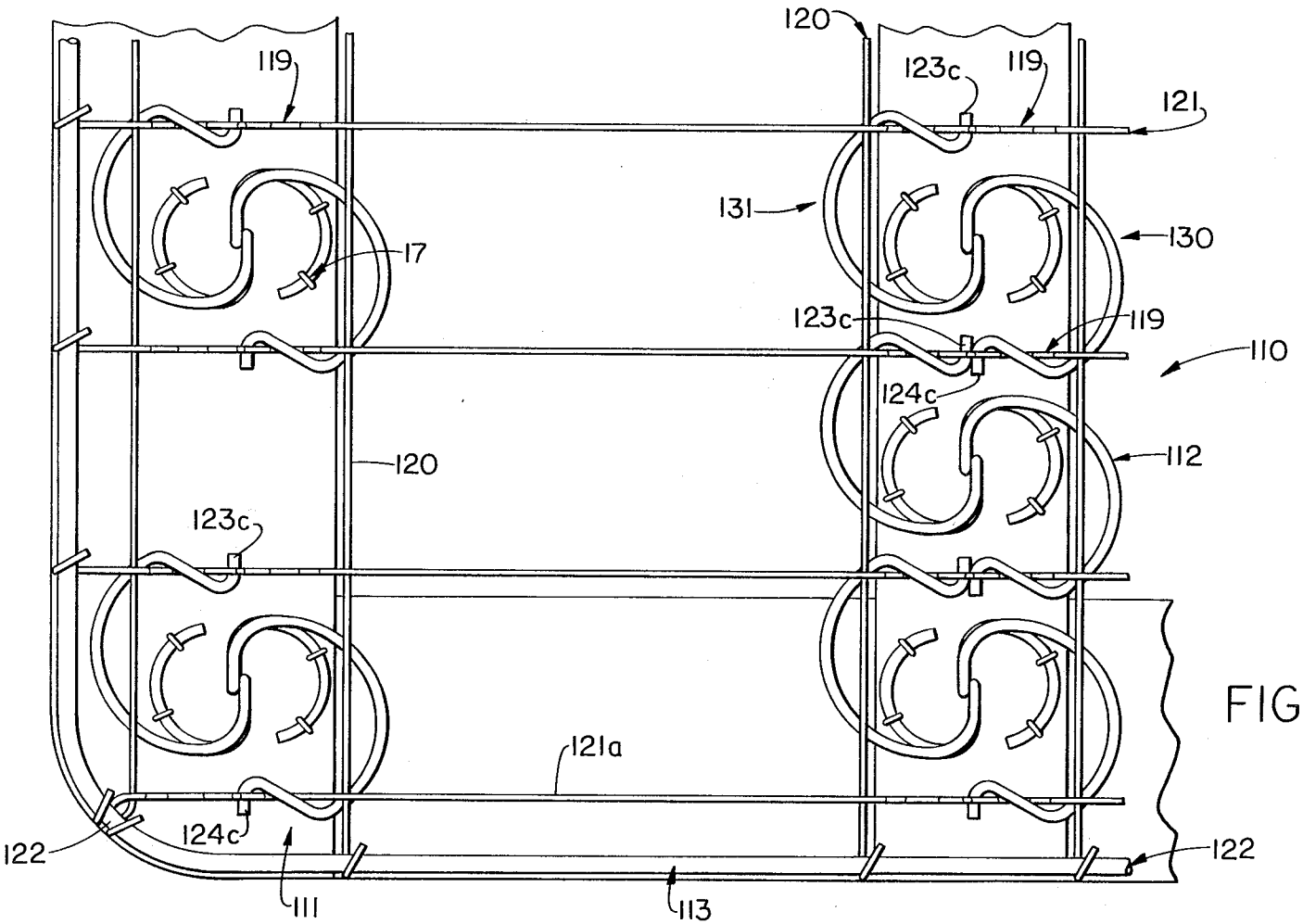
FIG. 6 is an enlarged top plan view of a corner portion of a second embodiment of a box spring incorporating the invention of this application, which second embodiment utilizes another method of attachment of the spring elements to the welded wire grid of the box spring.
Figure 7:
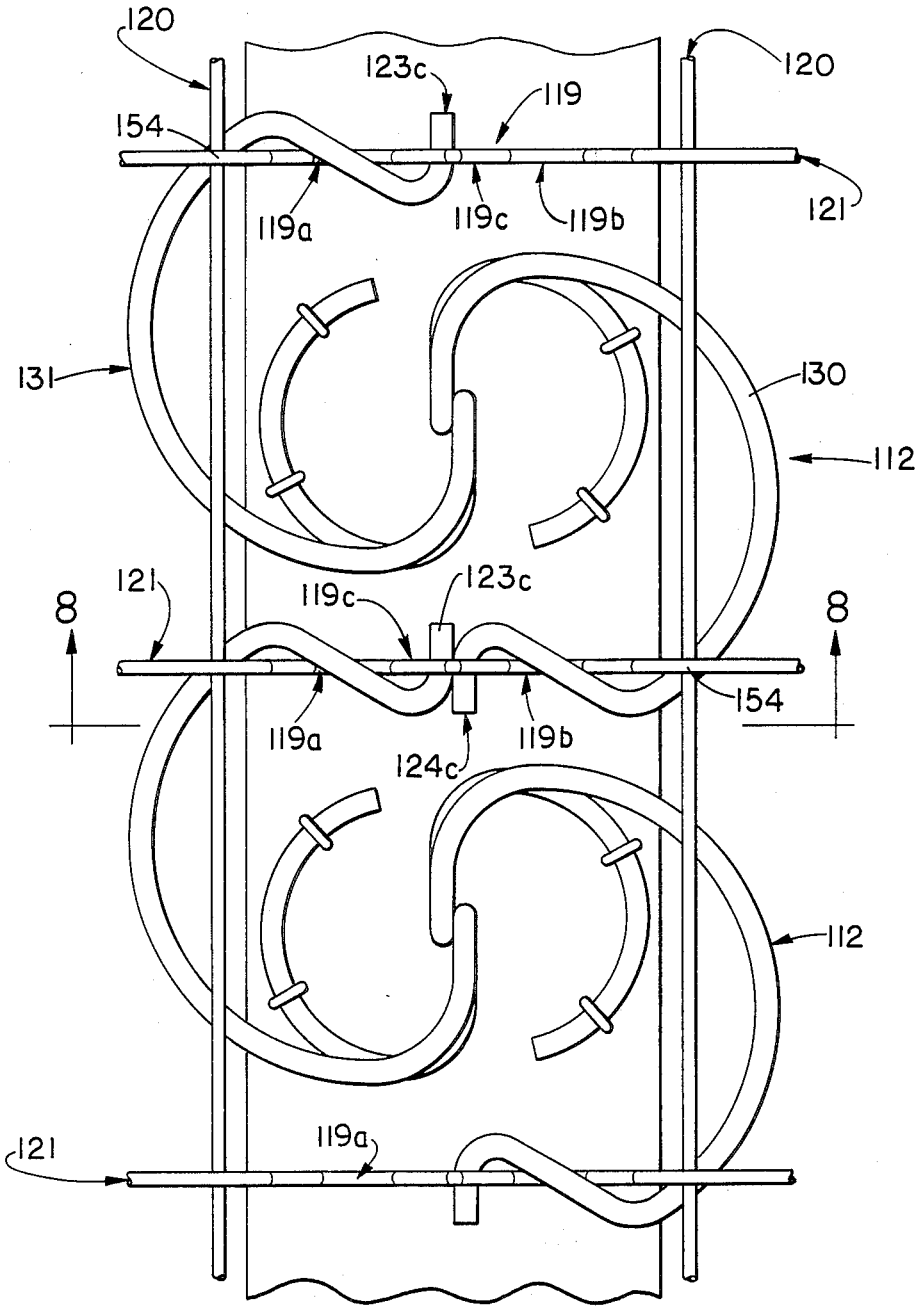
FIG. 7 is an enlarged fragmentary top plan view of a portion of the box spring shown in FIG. 6.
Figure 8:
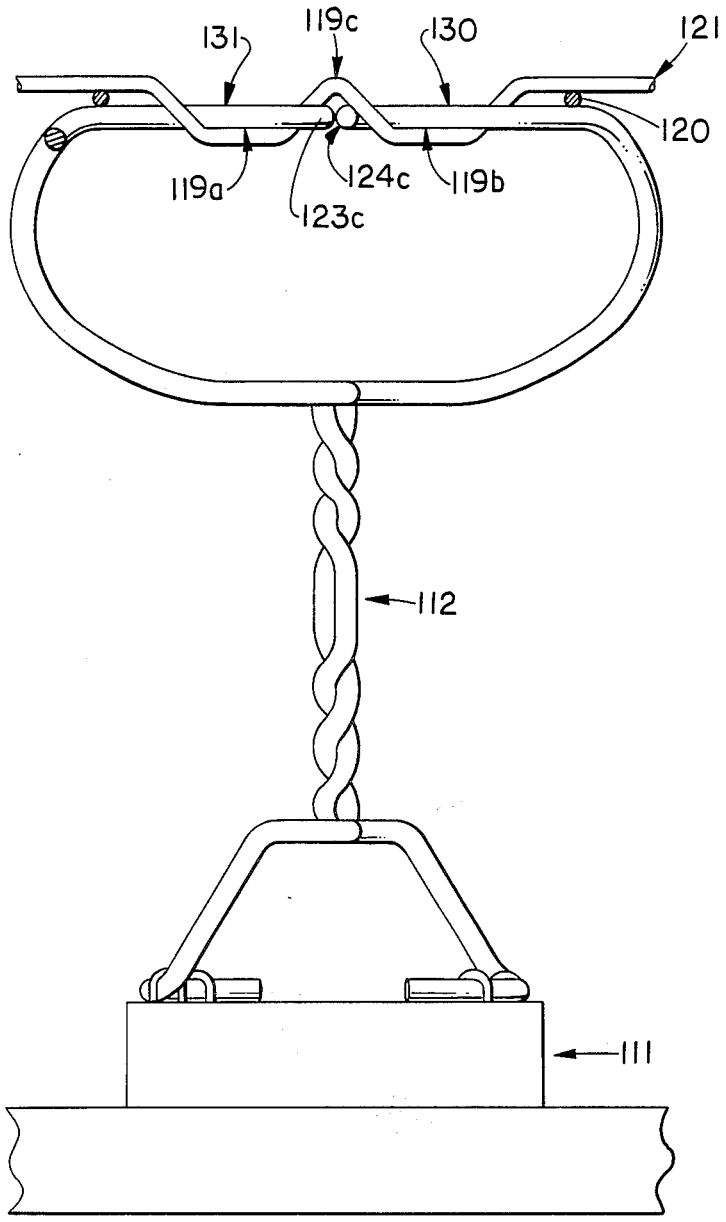
FIG. 8 is a cross-sectional view taken along lines 8—8 of FIG. 7.

With reference now to FIGS. 6, 7 and 8 there is illustrated a second embodiment of this invention. This embodiment differs from the first embodiment principally in that the spring support elements 112 are adapted for snap-in interconnection with the welded wire grid, rather than being connected to the welded wire grid by hooks preformed in the grid.

The box spring assembly 110 of this modification comprises a base frame 111 identical to the base frame 11 of the first embodiment of FIGS. 1–5. The spring support elements 112 of this modification are identical to the spring support elements 12 of the first modification except for the shape of the terminal end portion of the upper spring arms 130 and 131. In this second modification, the terminal end portions 123*c*, 124*c* of the upper spring arms are located in a horizontal plane as in the case of the first embodiment, but rather than being arcuate in configuration, the horizontal terminal end portions 123*c*, 124*c* are formed into an N-shaped configuration. This N-shaped configuration, as explained more fully hereinafter, is adapted to be snap-fit into appropriately configured longitudinal wires 121 of the welded wire grid 113.

The welded wire grid 113 comprises a rectangular border wire 122 identical to the border wire 22 of the first embodiment. It also comprises a plurality of spaced, parallel transverse wires 120 wrapped around and welded to opposite sides of the border wire 122. These transverse wires 120, though, are straight wires, rather than wires having hooks preformed therein, as in the case of the first embodiment.

Welded wire grid 113 also has a plurality of spaced longitudinal wires 121 extending between opposite sides of the rectangular border wire 122. The ends of these longitudinal wires are wrapped around the border wire and preferably secured thereto by welding. Intermediate the ends, each longitudinal wire 121 has a plurality of generally W-shaped deformations formed in the wire. These deformations 119 comprise a pair of spaced depressions or detents 119*a*, 119*b* separated by an inverted V-shaped section 119*c* (see FIG. 8). These W-shaped configurations 119 are spaced along the length of the longitudinal wires 121 in a position to receive the terminal N-shaped portions 123*c*, 124*c* of the upper spring arms 130, 131 of the spring support elements 112.

With reference particularly to FIGS. 7 and 8, it will be seen that each of the N-shaped portions 123*c*, 124*c* of the upper spring arms passes beneath an intersection 154 of a pair of the wires 120, 121 of the welded wire grid 113, through one depression or detent 119*a* or 119*b* of the W-shaped deformation 119 of a longitudinal wire, and beneath the inverted V-shaped section 119*c* of the W-shaped deformation 119 of the longitudinal wire. By deforming the N-shaped section during assembly of the spring support elements 112 with the welded wire grid 113, the terminal end portions of each of the upper spring arms may be snap-fit into the W-shaped configuration 119 of the welded wire grid. It will be seen, particularly with reference to FIG. 6, that the N-shaped terminal end portion of two different springs fit within each W-shaped deformation of each longitudinal wire, except in the case of the edgemost spring support elements 112. The edgemost longitudinal wire 121*a* of the welded wire grid only has one N-shaped terminal end section of an upper spring support arm received within each W-shaped section 119 of the longitudinal wire.

Although not illustrated in FIGS. 6, 7 and 8, this second embodiment of a box spring also has padding placed over the top of the welded wire grid and the complete assembly, including the base frame 111, the spring support elements 112, the welded wire grid 113, and the padding (not shown) is encased within a fabric covering (not shown).

This second embodiment 110 of a box spring has all of the advantages of the box spring of FIGS. 1–5. Specifically, it is subject to limited deflection before the rigidity of the center sections 125 of the spring support elements limits the flexibility of the spring elements and precludes the spring elements from taking a permanent set. It has the advantage, though, of enabling the spring elements to be attached to the welded wire grid or upper spring support element by means of snap-in interconnections of the upper arms of the spring support elements with the welded wire grid and without the need for hooks of the welded wire grid to be crimped shut to complete the assembly.

While we have described only two preferred embodiments of our invention, persons skilled in this art will appreciate changes and modifications which may be made without departing from the spirit of our invention. Therefore, we do not intended to be limited except by the scope of the following appended claims:

We claim:

1. A bedding foundation comprising a lower base frame an upper wire grid, a plurality of spring elements disposed and interconnected between said upper wire grid and said lower base frame, each of said spring elements comprising two discrete lengths of spring wire, each of said discrete lengths of spring wire having a center portion and two free end portions, said center portions of said discrete lengths of wire being twisted about one another to form an elongated, vertically oriented center portion of said spring element, a pair of upper and lower spring arms extending outwardly from said center portion of said spring element, said spring arms being formed by said free end portions of said two discrete lengths of spring wire, said upper spring arms being secured to said upper wire grid and said lower spring arms being secured to said lower base frame, padding mounted upon the top of said upper wire grid, and an upholstered covering encasing said lower base frame, said spring elements, said upper wire grid and said padding.

2. A bedding foundation comprising a lower base frame an upper support structure, a plurality of spring elements disposed and interconnected between said upper support structure and said lower base frame, each of said spring elements comprising two discrete lengths of spring wire, each of said discrete lengths of spring wire having a center portion and two free end portions, said center portions of said discrete lengths of wire being twisted about one another to form an elongated, vertically oriented center portion of said spring element, a pair of upper and lower spring arms extending outwardly from said center portion of said spring element, said spring arms being formed by said free end portions of said two discrete lengths of spring wire, said upper spring arms being secured to said upper support structure and said lower spring arms being secured to said lower base frame.

3. The bedding foundation of claim 2 wherein said upper spring arms of each of said spring elements spirals generally upwardly and outwardly from opposite sides of said center portion of said spring element.

4. The bedding foundation of claim 3 wherein said lower spring arms of each of said spring elements spirals generally downwardly and outwardly from opposite sides of said center portion of said spring elements.

5. The bedding foundation of claim 4 wherein said upper spring arms spiral outwardly in a larger diameter curve than the diameter of the spiral curve of the lower spring arms.

6. The bedding foundation of claim 2 wherein said upper spring arms of each of said spring elements extend generally outwardly in a first horizontal plane from opposite sides of said center portion of said spring element and then curve upwardly and outwardly from said first horizontal plane to curvilinear end portions located in a second horizontal plane spaced above said first horizontal plane.

7. The bedding foundation of claim 2 wherein said lower spring arms of each of said spring elements extend generally outwardly in a first horizontal plane from opposite sides of said center portion of said spring element and then curve downwardly and outwardly from said first horizontal plane to curvilinear end portions located in a second horizontal plane spaced beneath said first horizontal plane.

8. The bedding foundation of claim 7 wherein said upper spring arms of each of said spring elements extend generally outwardly in a third horizontal plane from opposite sides of said center portion of said spring element and then curve upwardly and outwardly from said third horizontal plane to curvilinear end portions located in a fourth horizontal plane spaced above said third horizontal plane.

9. The structure of claim 2 wherein said elongated vertically oriented center portion of said spring elements provide a rigid non-resilient support for said upper spring arms and said lower spring arms.

10. The bedding foundation of claim 2 wherein said upper support element is a wire grid, said upper spring arms terminating in N-shaped configurations, said N-shaped configurations being snap-fit into said wire grid so as to interconnect said spring elements to said wire grid.

11. A spring element for use in bedding and seating products, said spring element comprising two discrete lengths of spring wire, each of said discrete lengths of spring wire having a center portion and two free end portions, said center portions of said discrete lengths of wire being twisted about one another to form an elongated, vertically oriented center portion of said spring element, a pair of upper and lower spring arms extending outwardly from said center portion of said spring element, said spring arms being formed by said free end portions of said two discrete lengths of spring wire, said upper spring arms being adapted to be secured to an upper wire grid and said lower spring arms being adapted to be secured to a lower base frame.

12. The spring element of claim 11 wherein said upper spring arms of said spring element spirals generally upwardly and outwardly from opposite sides of said center portion of said spring element.

13. The spring element of claim 12 wherein said lower spring arms of said spring element spirals generally downwardly and outwardly from opposite sides of said center portion of said spring elements.

14. The spring element of claim 13 wherein said upper spring arms spiral outwardly in a larger diameter curve than the diameter of the spiral curve of the lower spring arms.

15. The spring element of claim 11 wherein said upper spring arms of said spring element extend generally outwardly in a first horizontal plane from opposite sides of said center portion of said spring element and then spiral upwardly and outwardly from said first horizontal plane to curvilinear end portions located in a second horizontal plane spaced above said first horizontal plane.

16. The spring element of claim 11 wherein said lower spring arms of said spring element extend generally outwardly in a first horizontal plane from opposite sides of said center portion of said spring element and then spiral downwardly and outwardly from said first horizontal plane to curvilinear end portions located in a second horizontal plane spaced beneath said first horizontal plane.

17. The spring element of claim 16 wherein said upper spring arms of said spring element extend generally outwardly in a third horizontal plane from opposite sides of said center portion of said spring element and then spiral upwardly and outwardly from said third horizontal plane to curvilinear end portions located in a fourth horizontal plane spaced above said third horizontal plane.

18. The structure of claim 11 wherein said elongated vertically oriented center portion of said spring element provides a rigid non-resilient support for said upper spring arms and said lower spring arms.

19. The spring element of claim 11 wherein said upper spring arms terminate in N-shaped configurations, said N-shaped configurations being adapted to be snap-fit into a wire grid.

* * * * *